United States Patent [19]

Flum et al.

[11] Patent Number: 4,801,024

[45] **Date of Patent: * Jan. 31, 1989**

[54] STACKABLE SHELVING SYSTEM

[75] Inventors: Paul L. Flum, Ladue, Mo.; Christopher C. Bidwell, Norcross, Ga.

[73] Assignee: Paul Flum Ideas, Inc., St. Louis, Mo.

[ * ] Notice: The portion of the term of this patent subsequent to Mar. 31, 2004 has been disclaimed.

[21] Appl. No.: 31,409

[22] Filed: Mar. 26, 1987

Related U.S. Application Data

[63] Continuation-in-part of Ser. No. 559,968, Dec. 9, 1983, Pat. No. 4,653,651.

[51] Int. Cl.[4] ..... A47F 7/00

[52] U.S. Cl. ..... 211/59.4; 211/74; 211/194; 108/53.1; 206/597

[58] Field of Search ..... 211/59.4, 71, 72, 74, 211/188, 194; 108/55.1, 55.3, 53.1, 55.5, 51.1; 206/597

[56] References Cited

U.S. PATENT DOCUMENTS

| | | | |
|---|---|---|---|
| 1,587,573 | 6/1926 | Young | 108/53.1 X |
| 3,944,070 | 3/1976 | Cardwell et al. | 108/53.1 X |
| 4,000,704 | 1/1977 | Griffin, Jr. | 108/53.1 |
| 4,653,651 | 3/1987 | Flum | 211/59.4 |
| 4,735,321 | 4/1988 | Day | 211/74 X |

*Primary Examiner*—Blair M. Johnson

*Attorney, Agent, or Firm*—Haverstock, Garrett & Roberts

[57] ABSTRACT

A bulk packaging and display system for holding, storing, transporting, displaying and merchandising product containers in a pre-stacked arrangement thereon comprising a base member having means thereon to locate and support a stack of product containers and a plurality of shelf members each adapted to rest upon respective layers of the product containers, said shelf members having upper and/or lower surfaces shaped to engage the product containers adjacent thereto, a relatively rigid member positioned forming the top of the display, and means binding the base member and top member with the layers of product containers positioned therebetween into a sturdy assembly suitable for moving, storing, transporting and displaying.

12 Claims, 3 Drawing Sheets

STACKABLE SHELVING SYSTEM

This is a continuation-in-part of pending Paul Flum U.S. patent application Ser. No. 559,968, filed Dec. 9, 1983, to issue as U.S. Pat. No. 4,653,651 on Mar. 31, 1987, entitled STACKABLE SHELVING SYSTEM.

BACKGROUND OF THE INVENTION

The present invention relates to product display devices for use in storing and merchandising shelved products and, more particularly, to various embodiments of a stackable shelving system adaptable for holding and merchandising a wide variety of products including bottled products and other products and the containers in which they are sold. Each shelving system includes a base shelf member adaptable to be supported on a floor or other support structure having means associated therewith for holding and retaining a plurality of products and product containers positioned thereon; and a plurality of additional shelf members each adaptable to rest upon and to be supported by the products or product containers positioned on the shelf member located therebelow. Each of the stackable shelf members also includes means on the bottom portion thereof for receiving and engaging the upper portion of the product containers upon which it is supported such as the cap or crown portions associated with bottled products as shown in the above referenced pending application. Each embodiment of the present system is specifically designed to accommodate a particular product container size and shape including single bottle and multi-pack arrangements and, although the present devices are ideally suited for holding and merchandising both single bottled and multi-pack bottled soft drink products, they are likewise adaptable for use in a multiplicity of other product display applications.

Numerous display systems and other devices including modular display fixtures have been designed and manufactured for use in merchandising bottled products such as soft drink products to customers. These display devices are commonly employed by supermarkets, convenience stores, grocery outlets, drug and liquor stores, fast food outlets, and a wide variety of other wholesale and retail stores and for use as both indoor and outdoor store displays to show off and focus attention on the wares displayed therein. One of the major problems associated with known systems for handling and displaying merchandise such as described above is the inability to handle large quantities of such merchandise in prestacked condition ready for placing in a store or other location such that when so placed and the binding straps, shrink fit cover or other bulk packaging is removed, the customers can remove the products, as required, until the display of products is exhausted, after which another prestacked display can be set in place to replace the now empty display. The present invention addresses the problem of conveniently packaging, handling, shipping, storing and displaying such merchandise, and in a manner that makes use of widely available equipment such as fork lift trucks, skid movers or other similar apparatus. The present invention is also readily available for use with prestacked displays on wheels or skids and the like.

Although various product shelving displays have been designed to alleviate some of the aforementioned problems, all such devices still suffer from certain disadvantages and shortcomings including being relatively large, bulky, short lived, awkward to handle, unstable, expensive, and difficult, if not impossible, to use on or in conjunction with conventional shelving and other display devices and arrangements presently available in supermarkets and other merchandising outlets.

The several embodiments of the present display system disclosed herein overcome many of the disadvantages and shortcomings associated with the known display devices, and teach the construction and operation of a relatively simple stackable shelving system adaptable for holding and merchandising therefrom both single bottled and multi-pack bottled soft drink products as well as a wide variety of other bottled and packaged goods. Each of the present display systems includes a base and/or a base shelf member adaptable to be supported on a floor or other support structure for holding and merchandising products positioned thereon; and a plurality of substantially similar shelf members each adaptable to rest upon and to be supported by the products positioned in a particular controlled way on the shelf member located immediately therebelow. Each base shelf member is preferably of a one-piece plastic molded construction and each includes opposed front and rear edges, opposed side edges, and a floor portion extending substantially the full length and width therebetween. The floor portion associated with each base shelf member is specifically constructed to accommodate and support a particular product or group of products positioned thereon depending upon the particular size and shape of the product containers to be displayed therein or the particular packaging arrangement associated therewith.

Once a manufacturer or other person stocks the base shelf member with a bottled or other product, he positions a shelf member on top of the previously loaded layer of products and, if necessary, makes sure that the shelf member is properly aligned on the next lower layer of products and thereafter stocks that particular shelf member. Each additional shelf member, when engaged with the products positioned therebelow, is supported by and stackably held on said layer of products immediately therebelow and this process may be repeated until any desired display height is achieved. This ability to stack each of the present shelf members directly upon the products positioned therebelow allows a user to maximize the available merchandising space as well as contributing to the required stability of the display system for shipping, handling, and on-locations use, and since the present devices can be conveniently positioned and arranged on any available floor space, they provide the user with greater flexibility in changing and relocating product displays while at the same time always providing a neat, orderly, safe and attractive arrangement of such products. The present device therefore enables displaying the maximum number of products in a given merchandising space.

The present invention teaches the addition to display systems of the type shown in the referenced application means to strap, shrink fit or apply other bulk packaging on such systems to prevent them from coming apart during shipping, handling and storage, and means which facilitate lifting, moving, rolling or sliding such prestacked display systems without endangering or damaging the products and without requiring that the merchant receiving the products has to do much more than locate the display system where he or she wants it for the convenience of the customers and of the merchant.

OBJECTS OF THE INVENTION

It is therefore a principal object of the present invention to provide prestacked shelving systems which are relatively rigid and can be easily and conveniently handled and moved into position for merchandising the products contained therein.

Another object is to provide a product merchandising system that is structurally and operationally relatively simple and inexpensive to make and install.

Another object is to provide a stackable shelving system which more effectively utilizes available merchandising areas and maximizes usage of the vertical space between shelved products.

Another object is to provide a stackable shelving system which organizes the products positioned thereon for attractive display and for easy access and removal.

Another object is to provide a stackable shelving system which organizes the products positioned thereon in an orderly, attractive and stable condition for ease of handling and storing.

Another object is to teach the construction of a stackable shelving system which can be prefilled by the user either during or after production in a palletized arrangement for ease of shipping, handling, storing and displaying of the particular products positioned thereon.

Another object is to provide a display system which can be handled by fork lift trucks, skid movers or similar apparatus and can also be made to be supported on wheels or skids for movement.

Another object is to strap around, shrink fit or apply bulk packaging around a display system prestacked with merchandise to provide a stable, easy to handle assembly which can also be used at the merchandizing site to display the products thereon as they are sold.

Another object is to provison a store with merchandise without adding to the permanent shelf space.

These and other objects and advantages of the present invention will become apparent to those skilled in the art after considering the following detailed specification which discloses several representative embodiments of the present shelving system in conjunction with the accompanying drawings, wherein:

DESCRIPTION OF THE PREFERRED EMBODIMENT

Figure 1:
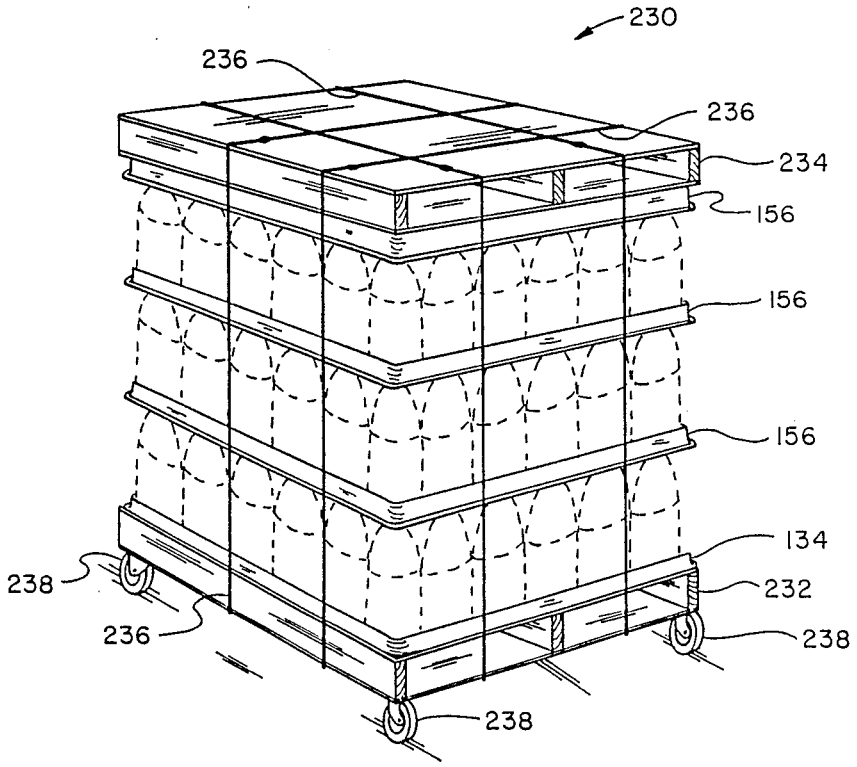
FIG. 1 is a perspective view of a prefilled palletized display according to the present invention.

Referring to the drawings more particularly by reference numbers, wherein like numerals refer to like parts, number 230 in FIG. 1, which is identical to FIG. 27 in the above referenced U.S. Pat. No. 4,653,651, identifies one embodiment of a product merchandising display system constructed according to the teachings of the present invention. The shelving display system 230 is designed for storing and merchandising products such as bottled products and it includes a base shelf member 232, a plurality of similar shelf members 156 spaced thereabove, and a top member shown as a pallet 234 in FIG. 1. In the construction 230, the base for the display stand is shown as the base pallet 232. A base shelf member such as the base shelf member 134 is positioned on the pallet 232 and layers of products with similar shelf members positioned on each layer, such as the members 156, are stacked thereabove. A top shelf member 156 is also positioned on the top layer of products. The second or upper pallet 234 or any other relatively rigid, non-yieldable member or structure is positioned thereabove to add additional strength and stability to the overall arrangement 230 and to allow for stackability of the arrangement during storage. The entire unit 230 is then banded together such as by bands 236 which preferably, although not necessarily, extend around the arrangement in several directions during shipment and storage. The rigidity of the members 232 and 234 allows the bands or straps 236 to be securely fastened therearound without causing damage to the individual shelf members or to the products positioned therewithin. This compact merchandising is especially advantageous for high volume users of a particular product where minimal handling and labor is important and where it is desired to use the same means 230 for shipping, transporting, handling, storing and actually displaying the products. The base pallet 232 may optionally include rolling means such as the casters or rollers 238 for easily moving the entire unit 230 across a supporting surface such as rolling it from a receiving area directly to a point of sale location.

The present devices provide simple and efficient means for effectively and attractively storing and merchandising various products therein while at the same time organizing and arranging the products for easy selection and access by the customer; they provide stable, stackable and orderly arrangements of the products displayed therein; they can be utilized in any convenient merchandising area including use in or adjacent to store aisles or any other available floor space; they can be utilized in conjunction with existing shelf space; they maximize use of the vertical space between shelved products; and, when empty they can be repeatedly transported back to the supplier for repacking and reuse. The unique design of the present shelf members also effectively locks the shelf members in place over the upper and/or lower portions of the products or product containers upon or under which they rest and this provides a straight, strong, sturdy, stable, and safe display of the particular goods items and it also enhances store appearance and gives maximum exposure of the products. Such an orderly arrangement of products also facilitates stocking and product rotation and aids in identifying and controlling inventory. Use of the present devices is also cost effective because they can be easily moved from one merchandising area to another and they require no additional parts. All of these features are particularly important to merchants because they increase the accessibility to the customer of the products being displayed and marketed thereon, and they more effectively and attractively utilize available merchandising space, all of which promotes sales. In addition, since the present devices are primarily adaptable to be supported on a floor or other similar support structure, when so utilized they free up a considerable amount of conventional store shelf space which may be utilized for displaying other merchandise. They also leave it more to the manufacturer as to how to display their merchandise and discourage the merchant from making changes.

Figure 2:
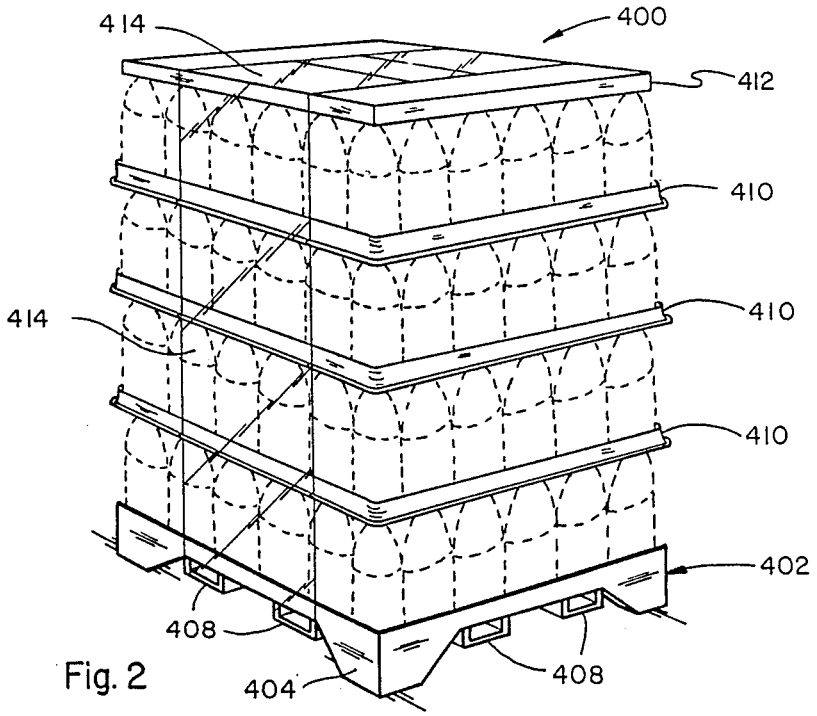
FIG. 2 is a perspective view showing another embodiment of a display according to the invention.

FIG. 2 shows a modified form 400 of the present device which form has a molded plastic base 402 with corner pedestal portions 404. The base 402 also has spaced slot or channel forming portions 408 which extend inwardly from all four sides. The slots or channels 408 are designed, shaped and spaced to accommodate the lifting tines (not shown) on a fork lift truck or similar lifting device so that such a truck can be used to lift and transport the assembly 400. The fact that the truck can approach for lifting the assembly from any direction is an important advantage to the warehouse or merchant who handles the assemblies and moves or transports them.

The assembly 400, like the assembly 230, has a plurality of similar spaced shelf members 410 which preferably have means to positively engage and support the products supported on the assembly and to provide sturdiness to the assembly. The molded plastic base 402 may also be provided with opposing side walls, as shown in FIG. 2, and product support means molded in the floor portion thereof, if desired. Alternatively, a base shelf member such as 134 can be positioned on the molded plastic base 402 as shown in FIG. 1. A relatively rigid upper support member 412 is positioned on the top layer of products or on the uppermost shelf member 410 to form the top of the assembly 400. The upper support member should be strong enough, and rigid enough that when straps are wound around the assembly, not shown, they will not yield appreciably at the edges to exert undue pressure on the products located near the edges of the device and allow for stackability during warehousing. Straps can be extended in one or both directions around the assembly 400 as desired, and it is contemplated with respect to the base portion 402 of the assembly 400 to run such straps through the same channels or slots used for receiving the tines of the fork lift truck.

Another suitable means of banding and stabilizing the assembly 400 and shown in FIG. 2 is by winding a shrinkable plastic wrap 414 about the assembly to bind the entire assembly, including the base 402 and upper support member 412, and stabilize the same for lifting, handling and transporting as by a fork lift or other means. The shrink wrap banding 414 can be extended in both vertical directions and/or horizontally around the assembly and the stacked products to provide added stability and security for the products, if desired. When the shrink band 414 is in place, it can be heated with a stream of hot air to shrink fit it to the assembly. Except for the differences noted above, the assembly 400 is similar and used similarly to the assembly 230.

Figure 3:
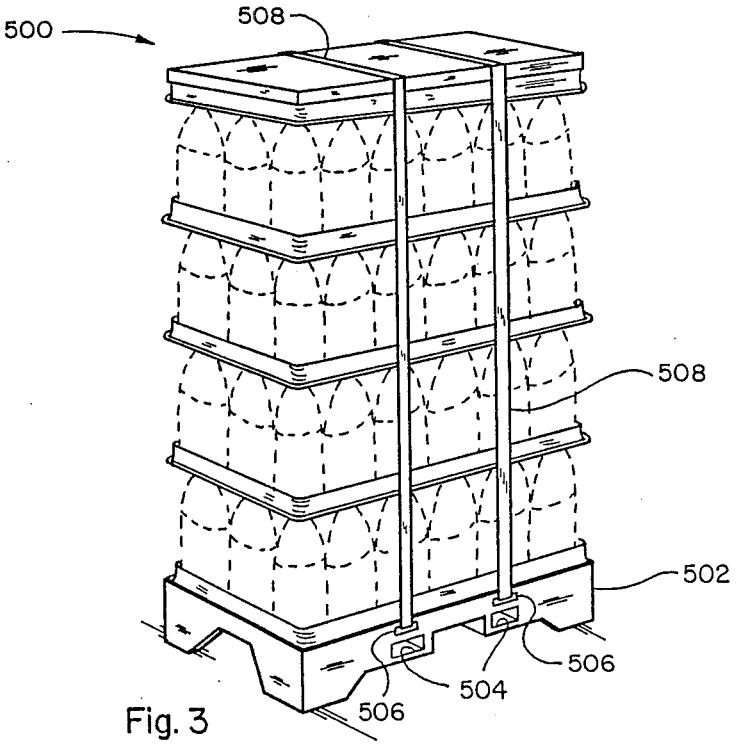
FIG. 3 is a perspective view showing yet another embodiment of the present display system.

The assembly 500 shown in FIG. 3 is also similar to the assemblies 230 and 400, differing therefrom primarily in the construction of base portion 502 which has spaced slots or channels 504 for receiving the tines of a fork lift lifting device. However, the assembly 500 also has separate slots 506 for receiving tie down straps 508 which are used to maintain the assembly in a sturdy condition during handling and moving. Similar slots could also be provided for accommodating straps going at right angles to the straps 508, if desired. The base 502 is also shown without casters or wheels which is the preferred embodiment. Lack of casters moves the lower layer of goods closer to the floor and possibly enables adding one or more layers of goods to the top of the assembly, which may be an advantage in some locations especially where space is at a premium. The assembly without casters is also more difficult to move when set in place and this may have advantages in some situations.

Thus there has been shown and described several embodiments of a novel stackable shelving system for use in storing, transporting, handling, displaying and merchandising shelved products, which devices and systems fulfill all of the objects and advantages sought therefor. Many changes, modifications, variations, and other uses and applications of the present devices and systems will, however, become apparent to those skilled in the art after considering this specification and the accompanying drawings. All such changes, modifications, variations, and other uses and applications which do not depart form the spirit and scope of the invention are deemed to be covered by the invention which is limited only by the claims which follow.

What is claimed is:

1. A bulk packaging and display system for holding, transporting and displaying product containers in a stackable arrangement comprising a base member, a base shelf member adaptable to be supported on said base member, said base shelf member including a product supporting floor portion extending substantially the full length width thereof and a wall portion extending therearound, said floor portion including a plurality of adjacent product support areas extending substantially thereover, each of said product support areas including a cavity adaptable for receiving and holding at least one product container positioned therewithin, a plurality of additional shelf members each adaptable to rest upon and to be supported by the product containers positioned on a shelf member located therebelow, each of said plurality of additional shelf members including means located on the floor portion thereof for cooperatively engaging the upper portion of the product containers positioned therebelow, the product containers being stackably arranged on said base shelf member and on said plurality of additional shelf members thereabove to a predetermined height, one of said plurality of additional shelf members being positioned to engage the upper portion of each product container located in the uppermost layer of product containers, a relatively non-yieldable member positioned on top of the uppermost shelf member, and means engageable with the base member and with the non-yieldable member for fastening the system together into a unitary structure.

2. The bulk packaging and display system of claim 1 wherein the base member is formed of molded plastic.

3. The bulk packaging and display system of claim 1 wherein said base member has channels formed extending therethrough in positions to cooperatively receive the lifting tines of a fork lift device.

4. The bulk packaging and display system of claim 1 wherein the base member has channels extending therethrough for receiving straps that extend around the display in vertical orientation.

5. The bulk packaging and display system of claim 1 wherein the means engageable with the base member and the non-yieldable member includes flexible strap members surrounding the system.

6. The bulk packaging and display system of claim 1 wherein the means engageable with the base member and the non-yieldable member includes a bulk packaging wrap surrounding the system.

7. The bulk packaging and display system of claim 1 wherein the base member includes caster means for moving the entire system across a supporting surface from one location to another.

8. The bulk packaging and display system of claim 1 wherein the base member and the base shelf member are integrally formed as a one piece molded plastic base member having a peripheral edge portion and a plurality of adjacent product support areas extending substantially over the surface thereof.

9. The bulk packaging and display system of claim 1 wherein said additional shelf members are constructed and dimensioned to substantially conform to said base shelf member.

10. A bulk packaging and display system for holding, transporting and displaying product containers in a stackable arrangement comprising a base member, a base shelf member adaptable to be supported on said base member, said base shelf member including a product supporting floor portion extending substantially the full length and width thereof and a wall portion extending therearound, said floor portion including a plurality of spaced upstanding wall portions extending upwardly therefrom, said plurality of upstanding wall portions being arranged in a grid-like pattern and forming a plurality of adjacent product support areas adaptable for locating and supporting at least one product container positioned respectively thereon, a plurality of additional shelf members each adaptable to rest upon and to be supported by the product containers positioned on a shelf member located therebelow, each of said plurality of additional shelf members including means located on the floor portion thereof for cooperatively engaging the upper portion of the product containers positioned therebelow, the product containers being stackably arranged on said base shelf member and on said plurality of additional shelf members thereabove to a predetermined height, one of said plurality of additional shelf members being positioned to engage the upper portion of each product container located in the uppermost layer of product containers, a relatively non-yieldable member positioned on top of the uppermost shelf member, and means engageable with the base member and with the non-yieldable member for fastening the system together into a unitary structure.

11. A bulk packaging and display system for holding, transporting and displaying product containers in a stackable arrangement comprising a base member, a base shelf member adaptable to be supported on said base member, said base shelf member including a product supporting floor portion extending substantially the full length an width thereof and a wall portion extending therearound, said floor portion including a plurality of adjacent product support areas extending substantially thereover, each of said product support areas including a cavity adaptable for receiving and holding at least one product container positioned therewithin, a plurality of additional shelf members each adaptable to rest upon and to be supported by the product containers positioned on a shelf member located therebelow, each of said plurality of additional shelf members including means located on the floor portion thereof for cooperatively engaging the upper portion of the product containers positioned therebelow, the product containers being stackably arranged on said base shelf member and on said plurality of additional shelf members thereabove to a predetermined height, means including a relatively non-yieldable member positioned to engage the upper portion of the product containers located in the uppermost layer of product containers, and other means engageable with said base member and with said means engageable with the uppermost layer of product containers for fastening the system together into a unitary structure.

12. A bulk packaging and display system for holding, transporting and displaying product containers in a stackable arrangement comprising a base member, a base shelf member adaptable to be supported on said base member, said base shelf member including a product supporting floor portion extending substantially the full length and width thereof and a wall portion extending therearound, said floor portion including a plurality of spaced upstanding wall portions extending upwardly therefrom, said plurality of upstanding wall portions being arranged in a grid-like pattern and forming a plurality of adjacent product support areas adaptable for locating and supporting at least one product container positioned respectively thereon, a plurality of additional shelf members each adaptable to rest upon and to be supported by the product containers positioned on a shelf member located therebelow, each of said plurality of additional shelf members including means located on the floor portion thereof for cooperatively engaging the upper portion of the product containers positioned therebelow, the product containers being stackably arranged on said base shelf member and on said plurality of additional shelf members thereabove to a predetermined height, means including a relatively non-yieldable member positioned to engage the upper portion of the product containers located in the uppermost layer of product containers, and other means engageable with said base member and with said means engageable with the uppermost layer of product containers for fastening the system together into a unitary structure.

* * * * *

UNITED STATES PATENT OFFICE

CERTIFICATE OF CORRECTION

Patent No. 4,801,024 Dated January 31, 1989

Inventor(s) Paul L. Flum and Christopher C. Bidwell

It is certified that error appears in the above-identified patent and that said Letters Patent is hereby corrected as shown below:

Column 3, line 48, after "display", insert --system constructed--.

Column 3, line 50, after "display", insert --system constructed--.

Column 6, line 22, after "length", insert --and--.

Column 7, line 46, "an" should be --and--.

Signed and Sealed this

Twenty-seventh Day of June, 1989

*Attest:*

DONALD J. QUIGG

*Attesting Officer*

*Commissioner of Patents and Trademarks*